US006471036B1

(12) United States Patent
Schlisio

(10) Patent No.: US 6,471,036 B1
(45) Date of Patent: Oct. 29, 2002

(54) METHOD OF AN APPARATUS FOR INVERTING FILTER CIGARETTES AND THE LIKE

(75) Inventor: Siegfried Schlisio, Geesthacht (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/565,371

(22) Filed: May 5, 2000

(30) Foreign Application Priority Data

May 5, 1999 (DE) ..... 199 20 760

(51) Int. Cl.[7] ..... B65G 47/24

(52) U.S. Cl. ..... 198/377.01; 198/377.04; 198/377.06; 198/377.1; 198/404; 198/406

(58) Field of Search ..... 198/951, 377.01–377.06, 198/377.1, 404, 406

(56) References Cited

U.S. PATENT DOCUMENTS

| | | | | |
|---|---|---|---|---|
| 3,319,764 A | * | 5/1967 | Gamberini | 198/951 |
| 3,583,546 A | | 6/1971 | Koop | |
| 4,090,602 A | * | 5/1978 | Schubert et al. | 198/951 |
| 4,483,351 A | * | 11/1984 | Seragnoli | 198/951 |
| 4,668,152 A | * | 5/1987 | Gomann et al. | 198/347.1 |
| 4,676,360 A | * | 6/1987 | Mattei et al. | 198/951 |
| 5,135,008 A | | 8/1992 | Oesterling et al. | |
| 5,556,504 A | * | 9/1996 | Rajala et al. | 156/519 |

FOREIGN PATENT DOCUMENTS

| | | |
|---|---|---|
| DE | 1 014 011 | 8/1957 |
| DE | 1 178 756 | 5/1965 |
| DE | 15 32 099 | 1/1970 |
| GB | 1 538 314 | 1/1979 |

* cited by examiner

*Primary Examiner*—Christopher P. Ellis
*Assistant Examiner*—Mark A. Deuble
(74) *Attorney, Agent, or Firm*—Venable; Robert Kinberg

(57) ABSTRACT

A drum-shaped conveyor rotates about a fixed axis and its core carries a set of angularly distributed sections indexible about axes extending radially of the fixed axis when the core is set in rotary motion. Each section has several parallel flutes for sets of discrete filter cigarettes which are turned end-for-end, as well as moved circumferentially and axially of the core, in response to each revolution of the core. Rotation of successive sections about the respective radial axes takes place at timely spaced intervals and in opposite directions. The conveyor can receive filter cigarettes from a maker and inverts the sets of cigarettes prior to admission of such articles into a packing machine.

34 Claims, 7 Drawing Sheets

METHOD OF AN APPARATUS FOR INVERTING FILTER CIGARETTES AND THE LIKE

CROSS-REFERENCE TO RELATED CASES

This application claims the priority of commonly owned German patent application Serial No. 199 20 760.7 filed May 5, 1999. The disclosure of the above-referenced German patent application, as well as that of each U.S. and foreign patent and patent application mentioned in the specification of the present application, is incorporated herein by reference.

BACKGROUND OF THE INVENTION

The present invention relates to improvements in methods of and in apparatus for manipulating rod-shaped articles, especially rod-shaped products of the tobacco processing industry. Typical examples of such rod-shaped products are filter cigarettes, cigars, cigarillos and other filter-tipped smokers' products.

It is customary to mass-produce filter cigarettes in machines or production lines of the type disclosed, for example, in commony owned U.S. Pat. No. 5,135,008 granted Aug. 4, 1992 to Erwin Oesterling et al. for "METHOD OF AND APPARATUS FOR MAKING FILTER CIGARETTES". Thus, filter mouthpieces of double unit length are placed between pairs of plain cigarettes of unit length and are secured thereto by so-called uniting bands (one side of each uniting band is coated with a film of a suitable adhesive) each of which is rolled around the entire mouthpiece as well as around the adjacent inner end portions of the respective plain cigarettes. The thus obtained filter cigarettes of double unit length are severed midway across their convoluted uniting bands to thus yield pairs of coaxial filter cigarettes of unit length. The filter mouthpieces of each pair of filter cigarettes of unit length are located next to each other; therefore, one filter cigarette of each pair must be turned around (inverted) end-for-end so that the filter mouthpieces of inverted and non-inverted cigarettes face in the same direction, and the inverted cigarettes are normally placed between the adjacent non-inverted cigarettes to form therewith a single layer or mass flow ready to be fed into a packing machine wherein arrays of, for example, four, five, ten or twenty filter cigarettes are confined in box-shaped containers or packets, e.g., in so-called soft packets or packs or in so-called hinged lid packets or packs.

The apparatus of Oesterling et al. can employ an inverting or turn-around device of the type disclosed in U.S. Pat. No. 3,583,546 granted Jun. 8, 1971 to Gerhard Koop for "APPARATUS FOR INVERTING CIGARETTES OR THE LIKE". The device of Koop employs a set of four horizontal drum-shaped conveyors and a so-called rotor which is rotatable about a vertical axis and operates between two spaced-apart drum-shaped conveyors to invert successive filter cigarettes of one of two rows of such filter cigarettes through an angle of 180° and to simultaneously move the filter cigarettes of the one row axially so that they can be deposited between successive cigarettes of the (non-inverted) other row. As a rule, the cigarettes are transported in axially parallel flutes at the peripheries of the drum-shaped conveyors and in flutes of discrete holders forming part of the aforementioned rotor.

The turn-around device of Koop constitutes but one of numerous apparatus or units which can be utilized in a filter cigarete making and processing line to invert one of two rows of filter cigarettes of unit length end-for-end preparatory to introduction of filter cigarettes into storage or into a packing machine. For example, German patent No. 11 78 756 discloses an apparatus which employs a rotary drum having pairs of axially parallel peripheral flutes for discrete filter cigarettes of unit length. Initially, the filters of each pair of cigarettes are located next to each other. One flute of each pair is rotatable about an axis which extends radially of the axis of the drum so that the respective filter cigarette of unit length can be turned through an angle of 180° and simultaneously caused to partially overlap the adjacent non-inverted filter cigarettes. Therefore, the just described patented turn-around apparatus must further employ a stationary cam or an analogous device which shifts successive inverted filter cigarettes axially to positions of full overlap with the non-inverted filter cigarettes.

A drawback of the just described patented turn-around apparatus is that it is highly complex and therefore expensive and prone to malfunction. Thus, one flute of each pair of flutes must be mounted on a discrete holder which is rotatable relative to the drum. Moreover, each inverted filter cigarette only partially overlies the adjacent non-inverted filter cigarettes so that it must thereafter be shifted axially by resorting to the aforementioned cam or the like. This renders it necessary to employ a large-diameter drum, and the cam is likely to damage (such as deface and/or deform) the freshly inverted filter cigarettes. Moreover, the speed of rotary movement of indexible flutes cannot exceed a certain value in order to avoid the generation of excessive centrifugal forces which tend to expel the filter cigarettes from their indexible flutes and necessitate the provision of means which attract the filter cigarettes or otherwise retain the filter cigarettes in their respective indexible flutes with a pronounced force which, too, can affect the quality of inverted and axially shifted filter cigarettes.

In accordance with another prior proposal (disclosed in U.K. patent No. 15 38 314), filter cigarettes of unit length are assembled into a mass flow, the mass flow is introduced into a receptacle, and the at least partially filled receptacle is thereupon turned so as to invert the confined filter cigarettes through 180°. The receptacle is thereupon emptied and the thus evacuated (freshly inverted) filter cigarettes of unit length are ready to merge into a mass flow of non-inverted filter cigarettes of unit length. Such proposal also exhibits a number of serious drawbacks. Thus, the introduction of a mass flow of filter cigarettes of unit length into a receptacle, the turning of the receptacle and the evacuation of thus inverted filter cigarettes from the receptacle consume a substantial amount of time so that the receptacle is likely to establish a bottleneck in a production line which turns out filter cigarettes and confines filter cigarettes in packets, e.g., in the aforemetioned soft packets or in the aforementioned hinged lid packets. Moreover, the filter cigarettes are likely to be damaged (such as deformed and/or defaced and/or relieved of tobacco particles) during introduction into, during rotation with and/or during evacuation from the receptacle. Consequently, the utilization of such turn-around devices entails (or can entail) the making of an inordinately large number of rejects which must be segregated from acceptable filter cigarettes prior to introduction into the packing machine.

In accordance with a further prior proposal, the two rows of filter cigarettes which are turned out, for example, in a production line including the apparatus disclosed in the '008 patent to Oesterling et al. (i.e., wherein the mouthpieces of filter cigarettes of one row are adjacent the mouthpieces of coaxial filter cigarettes of the other row) are moved axially and apart from each other by resorting to a suitable drum-shaped (spreading) conveyor (such as the conveyor 39 shown in FIG. 1 of the '008 patent). The thus manipulated filter cigarettes are transferred onto a conical inverting drum which causes the filter mouthpieces of all cigarettes to face in the same direction prior to transfer onto a further drum for advancement toward a packing machine or to storage.

The just described proposal exhibits the drawback that the production line must embody a spreading conveyor which contributes to the space requirements of the production line, especially to the floor space requirements (namely the so-called footprint). Furthermore, repeated transfer of filter cigarettes from conveyor to conveyor can affect the quality of the processed commodities, e.g., their appearance and/or the density of their tobacco fillers. Moreover, in spite of its bulk, the production line can employ only a relatively small conical inverting drum with closely adjacent flutes in order to prevent the generation of excessive centrifugal forces, namely centrifugal forces which must be opposed by strong suction generating and/or other devices serving to reliably hold filter cigarettes in their respective flutes.

German patent No. 15 32 089 discloses an inverting apparatus which constitutes a modification of the apparatus disclosed in the aforementioned German patent No. 11 78 756. Thus, one of the two rows of filter cigarettes supplied by a first drum-shaped conveyor is transferred onto a second drum-shaped conveyor whereon each of a series of fluted holders for individual filter cigarettes of the one row is rotatable relative to the second conveyor to thus turn the filter cigarettes of the one row end-for-end, and the inverted cigarettes of the one row are thereupon returned onto the first conveyor. The fluted holders of the second conveyor are not designed and/or mounted to change the axial positions of filter cigarettes in the course of the inverting step.

A drawback of the just described apparatus is that the inverted filter cigarettes which are returned onto the first drum-shaped conveyor must be shifted axially so that the inverted and shifted as well the non-inverted filter cigarettes form a single row wherein the filter mouthpieces of all cigarettes are adjacent each other and all cigarettes are parallel to one another. Alternatively, axial shifting of filter cigarettes forming the one row must take place prior to the inverting step. In either event, the patented apparatus is bulky and is apt to turn out numerous rejects due to repeated transfer and axial shifting of filter cigarettes forming the one row. Moreover, the output of the just described patented apparatus is very low because the first conveyor must be rotated or indexed at a relatively low speed in order to permit for orderly transfer of filter cigarettes of the one row from the first conveyor onto the second conveyor and for orderly transfer of inverted cigarettes from the second conveyor back onto the first conveyor. The angular movements of the first and second conveyors must be synchronized to ensure that each freshly inverted filter cigarette will be transferred from the second conveyor into an empty flute (or into an empty portion of a flute) of the first conveyor. As a rule, the first conveyor completes one full revolution during the interval which elapses between removal of a non-inverted filter cigarette from and the returning of the freshly inverted filter cigarette onto the first conveyor. If the just described turn-around apparatus is to be utilized in a modern high-speed production line employing one or more cigarette making machines which turn out up to and even in excess of 16,000 articles per minute, the second conveyor must be rotated at an enormous speed which entails the generation of undesirably pronounced centrifugal forces. Such forces should not exceed a certain threshold value in order to prevent ejection of filter cigarettes from the flutes of indexible holders forming part of or being carried by the second conveyor.

OBJECTS OF THE INVENTION

An object of the invention is to provide an inverting apparatus which can change the orientation of huge quantities of filter cigarettes or other rod-shaped articles per unit of time in a small area and without affecting or without unduly affecting the appearance and/or other desirable qualities of the inverted rod-shaped articles.

Another object of the invention is to provide an apparatus which does not exhibit (or at least reduces or lessens) the drawbacks of the aforedescribed conventional apparatus.

A further object of the invention is to provide an apparatus which generates relatively weak (actually minor) centrifugal forces even if it is put to use in a modern high-speed production line which makes plain cigarettes, filter rod sections, filter cigarettes and packets of filter cigarettes.

An additional object of the invention is to provide an apparatus wherein the positions of those articles which need not be inverted as well as the positions of articles which must be inverted are invariably controlled and maintained with a high degree of precision and predictability during each stage of processing on their way toward, during advancement through or along, and during advancement beyond the inverting station.

Still another object of the invention is to provide an inverting apparatus which turns out a fraction of the number of rejects that are expected to be turned out by a conventional inverting apparatus.

A further object of the invention is to provide the above outlined apparatus with novel and improved means for inverting and (if necessary) axially shifting high numbers of rod-shaped articles per unit of time.

Another object of the invention is to provide an apparatus of the above outlined character with novel and improved means for the advancement and simultaneous inversion of filter cigarettes or analogous rod-shaped commodities.

An additional object of the invention is to provide an apparatus which can simultaneously invert several rod-shaped articles to exactly the same extent and in a relatively small space without permitting any of the simultaneously inverted articles to interfere with the other articles and/or vice versa.

Still another object of the invention is to provide a novel and improved method of inverting successive rod-shaped articles end-for-end, particularly of inverting filter-tipped rod-shaped smokers' products in a production line which includes, or supplies smokers' products to, one or more packing machines.

A further object of the invention is to provide a method of treating deformable rod-shaped articles gently on their way toward, through and beyond an inverting or turn-around station, particularly in a production line for the making of packets or boxed arrays of packets of filter cigarettes or other filter-tipped rod-shaped smokers' products.

Another object of the invention is to provide a production line which embodies one or more inverting apparatus of the above outlined character, particularly a production line for the making and processing of filter-tipped rod-shaped articles of the tobacco processing industry.

An additional object of the invention is to provide an inverting apparatus which can be readily incorporated into existing production lines as a superior substitute for heretofore known and utilized inverting apparatus including the aforedescribed conventional inverting apparatus.

Still another object of the invention is to provide an inverting apparatus the floor space requirements of which are well below those of heretofore known inverting apparatus.

A further object of the invention is to provide a novel and improved combination of conveyors for use in the above outlined apparatus or in a production line embodying the above outlined apparatus.

Another object of the present invention is to provide a novel and improved combination of a drum-shaped conveyor and one or more indexible turn-around devices for plural rod-shaped articles which can be utilized with advantage in an apparatus of the above outlined character, especially in an apparatus which is utilized to invert, end-for-end, successive filter cigarettes of a series of parallel filter cigarettes.

SUMMARY OF THE INVENTION

One feature of the present invention resides in the provision of a method of manipulating (and more specifically turning end-for-end) elongated rod-shaped articles of the tobacco processing industry, especially filter cigarettes or other filter-tipped smokers' products. The improved method comprises the steps of advancing first and second rows of parallel rod-shaped articles sideways along parallel neighboring first and second paths, conveying the articles of the first row from the first path into and transporting the thus conveyed articles along a third path, simultaneously inverting successive groups of at least two articles each end-for-end in the third path, shifting the articles of the first row axially, moving the articles of the first row in a direction at right angles to their longitudinal extensions, and transferring the inverted articles from the third path into one of the first and second paths, particularly into the second path between the (non-inverted) articles of the second row.

At least one of the paths is or can constitute an endless path, especially an endless circular path.

The conveying step can be carried out from a predetermined portion of the first path, and the transferring step can be carried out into a predetermined portion of the second path, preferably a portion adjacent the predetermined portion of the first path.

The inverting step preferably includes simultaneously turning groups of two or more articles end-for-end through angles of 180°.

The shifting step can include moving the articles axially through distances at least approximating the lengths of the respective articles.

The advancing step can include maintaining neighboring articles of each row at first distances from each other, and the moving step can include moving the articles of the first row through second distances each of which approximates or matches half the first distance.

The inverting step can be carried out simultaneously with the moving step and/or shifting step, i.e., the shifting step can be carried out simultaneously with the moving step.

The inverting step can include turning alternate groups of articles in a clockwise direction and turning the other groups of articles in a counterclockwise direction. Furthermore, the inverting step can include turning each group of articles upon completed turning of the immediately preceding group through an oblique angle. A presently preferred oblique angle is 135°.

If the third path is an endless circular path, the inverting step can be carried out during advancement of groups of articles along approximately or exactly one-half of such circular path.

The first path can be disposed between the second and third paths, the first and second paths can constitute endless circular paths, the third path can constitute an endless circular path, and the diameter of the third path is or can be different from (e.g., larger than) the diameter of at least one of the first and second circular paths.

Another feature of the instant invention resides in the provision of an apparatus for manipulating (particularly for turning end-for-end) elongated rod-shaped articles, such as filter cigarettes. The improved apparatus comprises an inverting conveyor having means for advancing at least one row of successive parallel articles sideways along a predetermined (first) path, and at least one turn-around device having means for simultaneously inverting at least two parallel rod-shaped articles of the at least one row end-for-end. The apparatus further comprises means for supplying articles to the advancing means of the inverting conveyor.

In accordance with a presently preferred embodiment, the inverting conveyor comprises a drum and the advancing means comprises a plurality of elongated peripheral receptacles (hereinafter called flutes for short) which are provided on the drum. The latter comprises a first or main section which is rotatable about a predetermined axis and at least one second section supported by and rotatable with the first section. The at least one second section constitutes the aforementioned turn-around device and is rotatable about a second axis extending at least substantially radially of the predetermined axis. The flutes can include an array of flutes provided on the at least one second section of the drum; such array can comprise a first group and a second group of, for example, four (i.e., at least two) flutes each. The two groups are located at opposite sides of a plane which includes the (second) axis about which the at least one second section rotates. The arrangement is preferably such that the flutes of each group include a first flute disposed at a first distance from the second axis and a second flute disposed at a second distance from the respective first flute. The first distance is half the second distance.

The at least one second section of the drum (inverting conveyor) is rotatable about the second axis from a starting position to a second position to thereby turn the articles in the flutes of the array of flutes on the at least one second section end-for-end. The flutes of such array are or can be at least substantially parallel to the predetermined axis in the starting and/or in the second position of the at least one second section (i.e., of the at least one turn-around device).

A presently preferred embodiment of the improved apparatus further comprises means for rotating the first section about the predetermined axis and means for rotating the at least one second section about the second axis through 180° during each revolution of the first section about the predetermined axis.

The drum can comprise a plurality of second sections which are carried by and are rotatable relative to the first section about discrete second axes extending radially of the predetermined axis. Such apparatus preferably further comprises means for rotating the second sections relative to the first section at timely spaced intervals. For example, if the second sections include at least two successive second sections (as seen in the circumferential direction of the drum), the means for rotating the second sections at timely spaced intervals can include means for rotating the successive second sections one after the other. Such means for rotating can include means for turning one of the successive second sections upon completed turning of the other of such successive second sections through an angle of at least approximately 135°. Furthermore, the just discussed means for rotating can include means for turning the successive second sections in opposite directions The means for supplying articles to the advancing means of the inverting conveyor can include a second conveyor having means for delivering articles to be inverted to the peripheral flutes of the advancing means and for receiving inverted articles from such flutes. The second conveyor can also include a drum, and the delivering means of the second conveyor can include axially parallel peripheral flutes arranged to advance several rows of parallel articles and to deliver successive articles of the at least one row to the flutes of the at least one second section of the inverting conveyor. Such at least one second section of the inverting conveyor can be arranged to return inverted articles to the drum of the second conveyor upon completion of one full revolution of each article about the predetermined axis of the first section of the inverting convyor.

The arrangement can be such that each flute of the drum of the second conveyor has a length which suffices to receive several (e.g., two) coaxial rod-shaped articles, and such second conveyor can be positioned to deliver articles of at least one of the several rows to the peripheral flutes of the inverting conveyor. For example, only the articles of the at least one row can be delivered to the flutes of the inverting conveyor.

The flutes of the second conveyor can include first flutes arranged to deliver successive articles of the at least one row to the flutes of the inverting conveyor and second flutes alternating with the first flutes and arranged to receive inverted rod-shaped articles from the flutes of the inverting conveyor.

The means for rotating the at least one second section of the inverting conveyor relative to the first section can include at least one crank drive which is arranged to rotate the at least one second section about the second axis (i.e., about an axis extending radially of the predetermined axis).

The inverting conveyor can include a first drive which serves to rotate the first section of such conveyor about the predetermined axis, and a second drive which serves to rotate the at least one second section of the inverting conveyor about the second axis. The first drive can include a shaft which defines the predetermined axis, and the second drive preferably derives motion from the shaft of the first section. Such second drive can include follower means operatively connected with the at least one second section and arranged to orbit about the predetermined axis in response to rotation of the first section about such axis, and means for moving a portion of the follower means in parallelism with the predetermined axis in response to rotation of the first section. The means for moving a portion of the follower means can comprise a stationary cam having a face which is tracked by such portion of the follower means. The latter can include a reciprocable follower member which tracks at least one cam of the moving means, a crankshaft which is coupled with the at least one second section, and a link which connects the follower member with the crankshaft. The at least one second section of the inverting conveyor can include a shaft which defines the (second) axis of the at least one second section, and the aforementioned follower means can further comprise a gear train which serves to transmit torque between the crankshaft and the shaft of the at least one second section. A presently preferred ratio of the gear train is two-to-one.

The second drive can be arranged to turn the at least one second section of the inverting conveyor about its (second) axis through 180° in response to each full revolution of the first section of the inverting conveyor about the predetermined axis. The second drive can further comprise means (such as one or more coil springs) for biasing the aforementioned portion of the follower means against (the cam or cams of) the moving means. The follower means can comprise a plurality of pushers which are operatively connected with the shaft of the at least one second section. The pushers can be arranged to act upon angularly spaced-apart portions of a crankshaft forming part of the second drive and drivingly connected to the shaft of the at least one second section of the inverting conveyor; for example, such portions of the crankshaft can constitute crank pins and can be angularly spaced apart by approximately or exactly 120°.

The inverting conveyor can form part of a cigarette making machine, such as a filter cigarette maker known as MAX-S (distributed by the assignee of the present application).

The novel features which are considered as characteristic of the invention are set forth in particular in the appended claims. The improved inverting apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
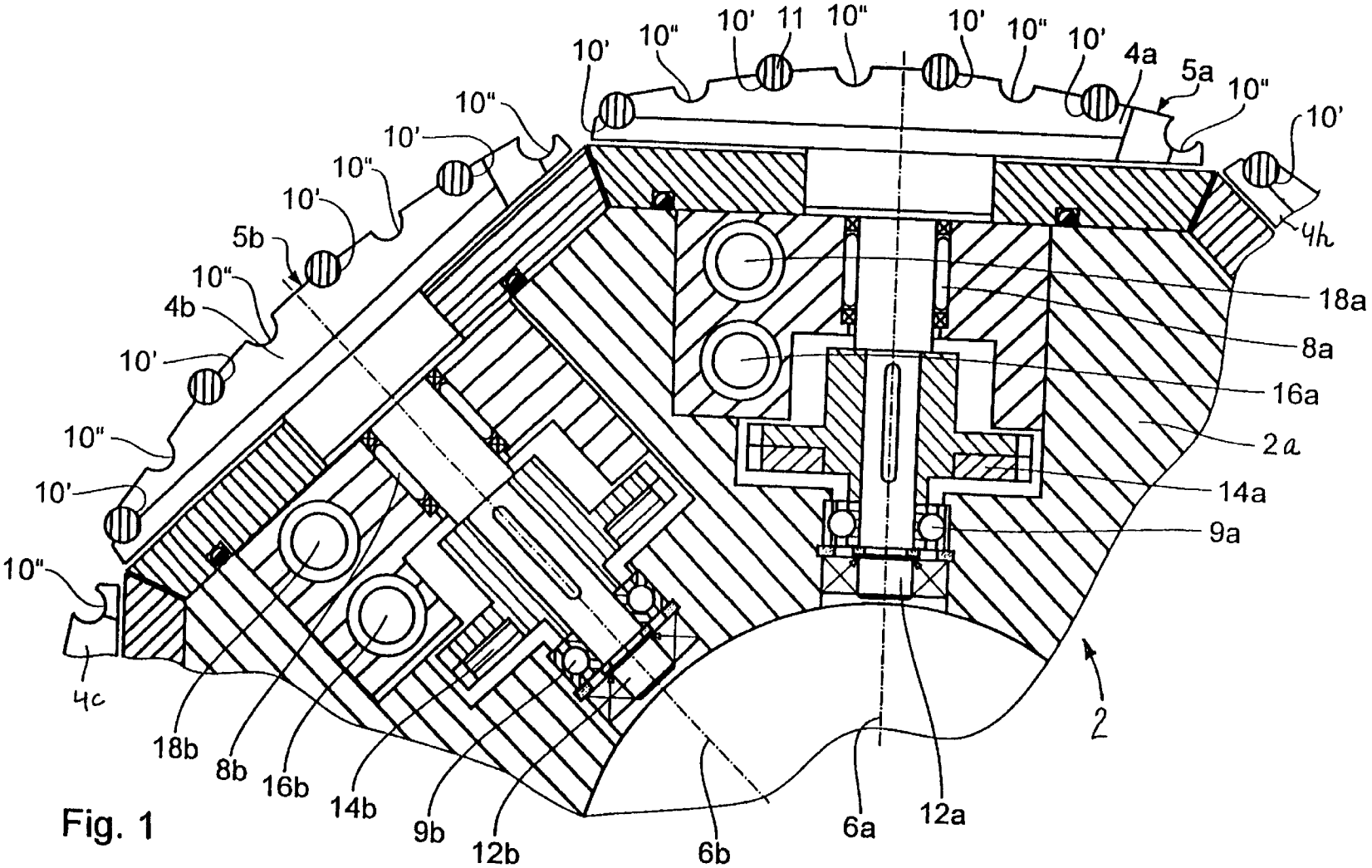
FIG. 1 is a fragmentary transverse sectional view of a rotary drum-shaped inverting conveyor which can be utilized in an apparatus embodying the present invention and wherein a rotary first section of the conveyor carries an annulus of discrete second sections each of which constitutes a device for simultaneous end-for-end turning of two or more parallel rod-shaped articles, particularly filter cigarettes of unit length.

FIG. 1 shows a portion of an apparatus 1 (FIG. 5) including a drum-shaped inverting conveyor 2 composed of a rotary first section or core 2*a* and a total of eight preferably identical second sections each of which constitutes a discrete turn-around device for several parallel elongated rod-shaped articles 11. Each of the illustrated articles 11 is a filter cigarette or another filter-tipped rod-shaped product of the tobacco processing industry.

FIG. 1 shows four second sections 4*a*, 4*b*, 4*c* and 4*h* which are supported by and are rotatable with and relative to the first section 2*a*. The other four second sections of the inverting conveyor 2 are mirror images of the illustrated second sections 4*a*, 4*b*, 4*c*, 4*h* with reference to a horizontal plane including the (predetermined) axis X of the first section 2*a*. The axis X is defined by a shaft 2*b* (FIG. 5) which forms part of a drive means for rotating the inverting conveyor 2 about the axis X. The eight second sections of the conveyor 2 are compelled to share all angular movements of the first section 2*a* about the axis X, and each such second section is further rotatable (indexible) about a discrete second axis extending radially of the axis X. FIG. 1 shows the axes 6*a*, 6*b* of the second sections 4*a*, 4*b*.

The eight second sections (including the four sections 4*a*–4*c*, 4*h* shown in FIG. 1) form an annulus which surrounds a portion of the first section 2*a*, i.e., the second sections are disposed one after the other as seen in a circumferential direction of the inverting conveyor 2. As can be seen in FIG. 1, the second section 4*a* is rotatably journalled in the first section 2*a* by way of a needle bearing 8*a* and a ball bearing 9*a*. Similar bearings 8*b*, 9*b* are employed to rotatably mount the second section 4*b* in the first section 2*a* of the conveyor 2.

Figure 2:
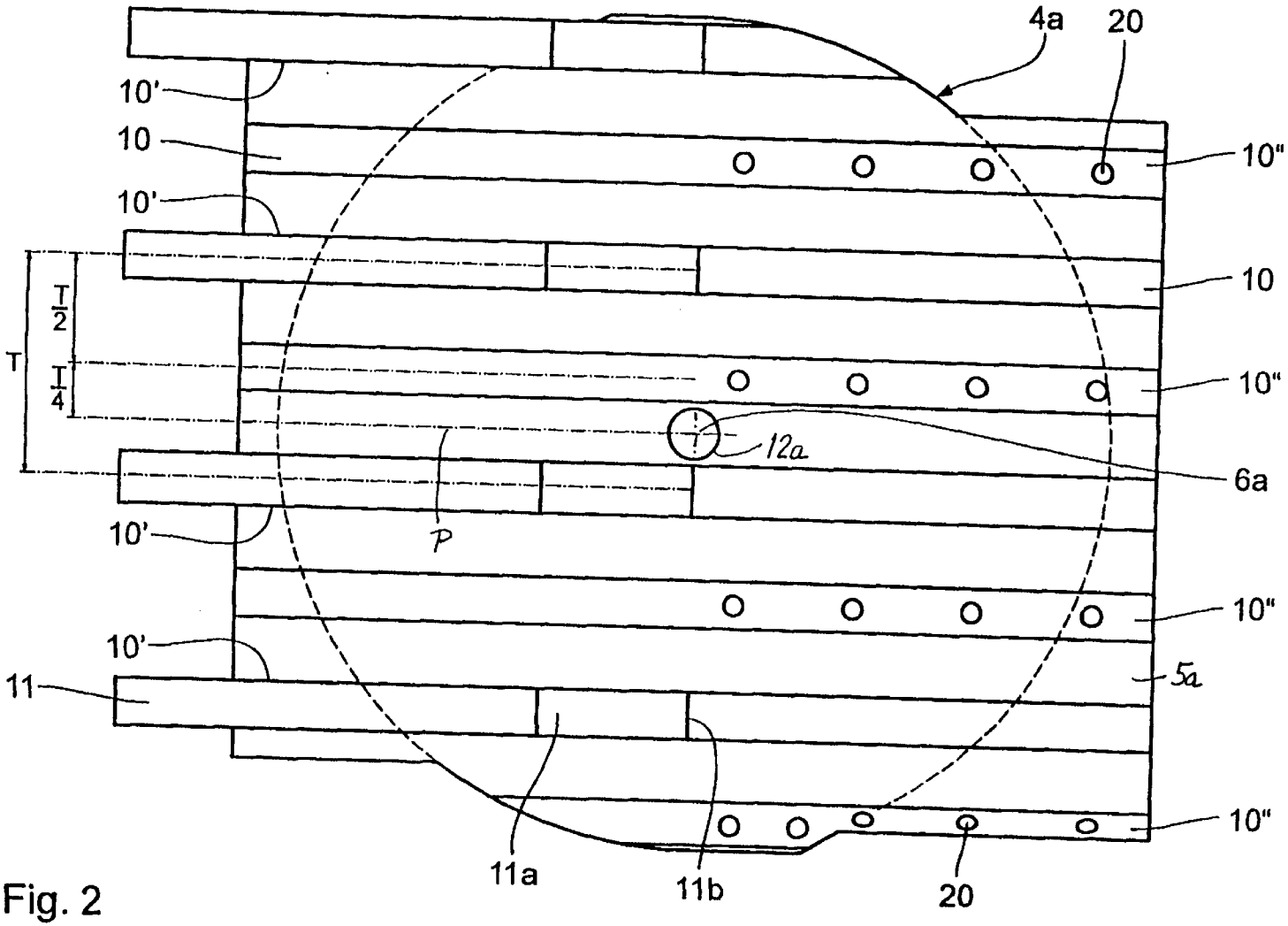
FIG. 2 is an enlarged plan view of one of the second sections shown in FIG. 1.
Figure 3:
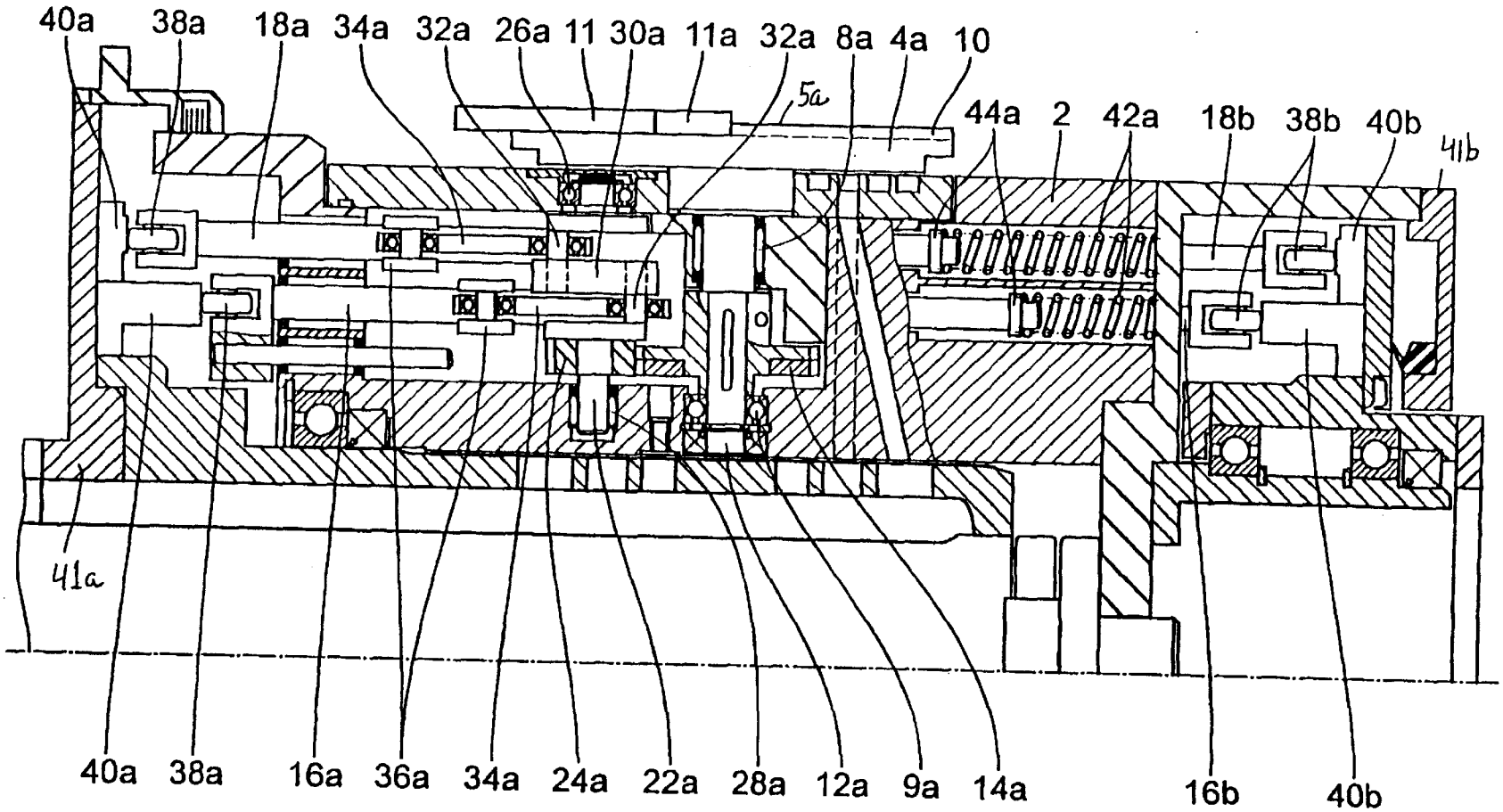
FIG. 3 is a fragmentary axial sectional view of the inverting conveyor, the section being taken in a plane which is normal to the plane of FIG. 1.

The means for advancing a row of successive rod-shaped articles 11 sideways during rotation of the conveyor 2 in a counterclockwise direction (see the arrow 2*c* in FIG. 5) comprises receptacles 10 in the form of elongated flutes provided in the exposed external (peripheral) surfaces of the second sections. FIGS. 1 to 3 shows the peripheral surface Sa of the second section 4*a*, and FIG. 1 further shows the exposed external peripheral surface 5*b* of the second section 4*b*.

The axes 6*a*, 6*b* are respectively defined by the shafts 12*a*, 12*b* of the second sections 4*a*, 4*b*, and such axes are normal to the flutes 10 in the respective external surfaces 5*a*, 5*b*. FIG. 2 shows that the flutes 10 in the external surface 5*a* of the second section 4*a* form an array composed of two groups which are disposed at opposite sides of a symmetry plane P including the axis 6*a*. The flutes 10 of each group include a first flute nearest to the axis 6*a* and spaced apart from the plane P by a first distance T/4, a second flute spaced apart from the first flute by a second distance T/2 which is twice the distance T/4, and two additional flutes. The flutes 10 of each group are equally spaced apart from each other (by distances T/2). Each flute 10' is partially occupied by a rod-shaped article 11, and such flutes 10' alternate with empty flutes 10" . The distance between two neighboring flutes 10' equals T.

Each rod-shaped article 11 is a filter cigarette of unit length having a filter mouthpiece or filter plug 11*a* of unit length. The free end faces 11*b* of the filter mouthpieces 11*a* are located in a common plane which is normal to the plane P and includes the axis 6*a*. Each flute 10 communicates with several (e.g., four) preferably equidistant suction ports 20 which are communicatively connected with a suction pump, with the intake of a fan, with a suction chamber or with any other suitable suction generating device (not specifically shown) serving to attract the rod-shaped article 11 to the concave surface bounding the respective flute (10' in FIG. 2) in certain angular positions of the drum-shaped inverting conveyor 2. The same holds true for each of the seven other second sections including the sections 4*b*, 4*c* and 4*h*.

The shafts 12*a*, 12*b* of the second sections 4*a*, 4*b* respectively carry and are non-rotatably connected with spur gears 14*a*, 14*b* (see FIG. 1). These spur gears are rotatable (indexible) by discrete driving units which respectively include pairs of pushers 16*a*, 18*a* and 16*b*, 18*b*; the pushers are normal to the axes 6*a*, 6*b* of the shafts 12*a*, 12*b* and are parallel to the (predetermined) axis X of the shaft 2*b* forming part of the means for rotating the first section 2*a* of the inverting conveyor 2.

Referring again to FIG. 2, each flute 10 in the peripheral surface 5*a* of the second section 4*a* need not be provided with suction ports 20 all the way from the one to the other of its ends. The reason is that only a portion of each of these flutes is occupied by a rod-shaped article 11 in actual use of the inverting conveyor 2. The means for supplying rod-shaped articles 11 to the flutes 10' of the section 4*a* comprises a second drum-shaped conveyor 62 (FIG. 5) having axially parallel peripheral flutes 64 which deliver rod-shaped articles 11 to the flutes of successive sections 4*a*, 4*b*, 4*c*, . . . 4*h* at a transfer station TS (see FIG. 5). In fact, one-half of each of the flutes 10', 10" shown in FIG. 2 can be omitted;

each of the flutes 10', 10" extends all the way across the peripheral surface 5*a* only for convenience of the manufacture. The necessary or active portions of the flutes 10' and 10" are those which are provided with the suction ports 20; the suction ports 20 in the flutes 10' of FIG. 2 cannot be seen because they are overlapped and hence concealed by the rod-shaped articles 11.

A turning of the section 4*a* of FIG. 2 through an angle of 180° (e.g., in a clockwise direction, as viewed in FIG. 2) causes a simultaneous turning or inversion of articles 11 end-for-end with attendant axial displacement of such articles by the length of an article (because the end faces 11*b* are located in the aforementioned plane including the axis 6*a* and being normal to the plane P).

FIGS. 1 to 3 show that the second section (turn-around device) 4*a* includes a round radially inner portion which is rotatably mounted in the first section 2*a*, and a platform-like radially outer portion including the exposed surface 5*a* and the flutes 10 (10'+10") therein. The construction of each of the other seven second sections (including those numbered 4*b*, 4*c*, 4*h* in FIG. 1) is or can be identical with that of the section 4*a*. Only the section 4*b* is shown in greater detail and its parts are denoted by reference numerals identical with those denoting the parts of the section 4*a* but each followed by the letter "b" (in lieu of the letter "a").

Referring now in greater detail to FIG. 3, the spur gear 14*a* on the shaft 12*a* of the second section 4*a* mates with a spur gear 24*a* carried by a crankshaft 22*a*. The latter is rotatable in a ball bearing 26 and in a needle bearing 28*b*, both installed in the first section 2*a* of the inverting conveyor 2. The crankshaft 22*a* of FIG. 3 is substantially S-shaped and includes a centrally located disc 30*a* carrying two eccentric crank pins 32*a*, one at each side of the disc 30*a*. Each of the two crank pins 32*a* is articulately coupled to one end portion of a discrete link 34*a*. The other end portions of the links 34*a* are coupled to forks 36*a* each of which is rigidly connected to one of the aforementined pushers 16*a*, 18*a*.

Those end portions of the pushers 16*a*, 18*a* which are remote from the forks 36*a* carry roller followers 38*a* arranged to track two stationary moving means here shown as annular cams 40*a* spacedly surrounding the axis X, i.e., the shaft 2*b* of the first section 2*a* of the inverting conveyor 2. Thus, when the first section 2*a* is compelled to rotate about the axis X, the second section 4*a* is compelled to rotate about the axis 6*a*.

In order to ensure that the follower means including the pushers 16*a*, 18*a* and the respective roller followers 38*a* invariably engage and thus track the respective cams 40*a*, the structure shown in FIG. 3 further comprises means 42*a* (here shown as prestressed coil springs) for biasing the roller followers 38*a* against the respective moving means (cams) 40*a*. The coil springs 42*a* react against the first section 2*a* and bear against suitable collars 44*a* provided at those ends of the pushers 16*a*, 18*a* which are remote from the respective roller followers 38*a*.

In order to turn the second section 4*a* about the axis 6*a* of the shaft 12*a*, the shaft 2*b* of the first section 2*a* is set in rotary motion by a suitable prime mover (not shown). As the first section 2*a* rotates about the axis X, the motion transmitting crank drive or second drive of FIG. 3 compels the second section 4*a* to orbit about the axis X, i.e., to rotate with the first section 2*a* and to simultaneously turn relative to the section 2*a*, namely about the axis 6*a* which extends radially of the axis X. Orbiting of the second section 4*a* about the axis X is not shared by the stationary cams 40*a* which are tracked by the roller followers 38*a* while the respective spring-biased pushers 16*a*, 18*a* orbit about the axis X. The roller followers 38*a* cause the respective pushers 16*a*, 18*a* to move in parallelism with the axis X, and the configurations of the faces of the cams 40*a* are such that the roller followers 38*a* and the pushers 16*a*, 18*a* cause the forks 36*a*, links 34*a* and crank pins 32*a* to turn the disc 30*a* which, in turn, causes the shaft 12*a* to turn the second section 4*a* about the axis 6*a*. The gar 24*a* is rigid with the crankshaft 22*a* and mates with the gear 14*a* which, in turn, transmits torque to the shaft 12*a* of the second section 4*a*.

The transmission ratio of the gear train including the gears 14*a*, 24*a* is two-to-one, i.e., each full revolution of the first section 2*a* about the axis X entails an angular movement of the second section 4*a* (and of the rod-shaped articles 11 in the flutes 10' provided in the exposed peripheral surface 5*a* of the section 4*a*) through 180°. Otherwise stated, each turning of the crankshaft 22*a* causes the shaft 12*a* to complete one-half of a revolution about the axis 6*a*. This causes the articles 11 shown in FIG. 2 to move to the other side of the vertical plane including the axis 6*a* and being normal to the plane P.

Figure 4:
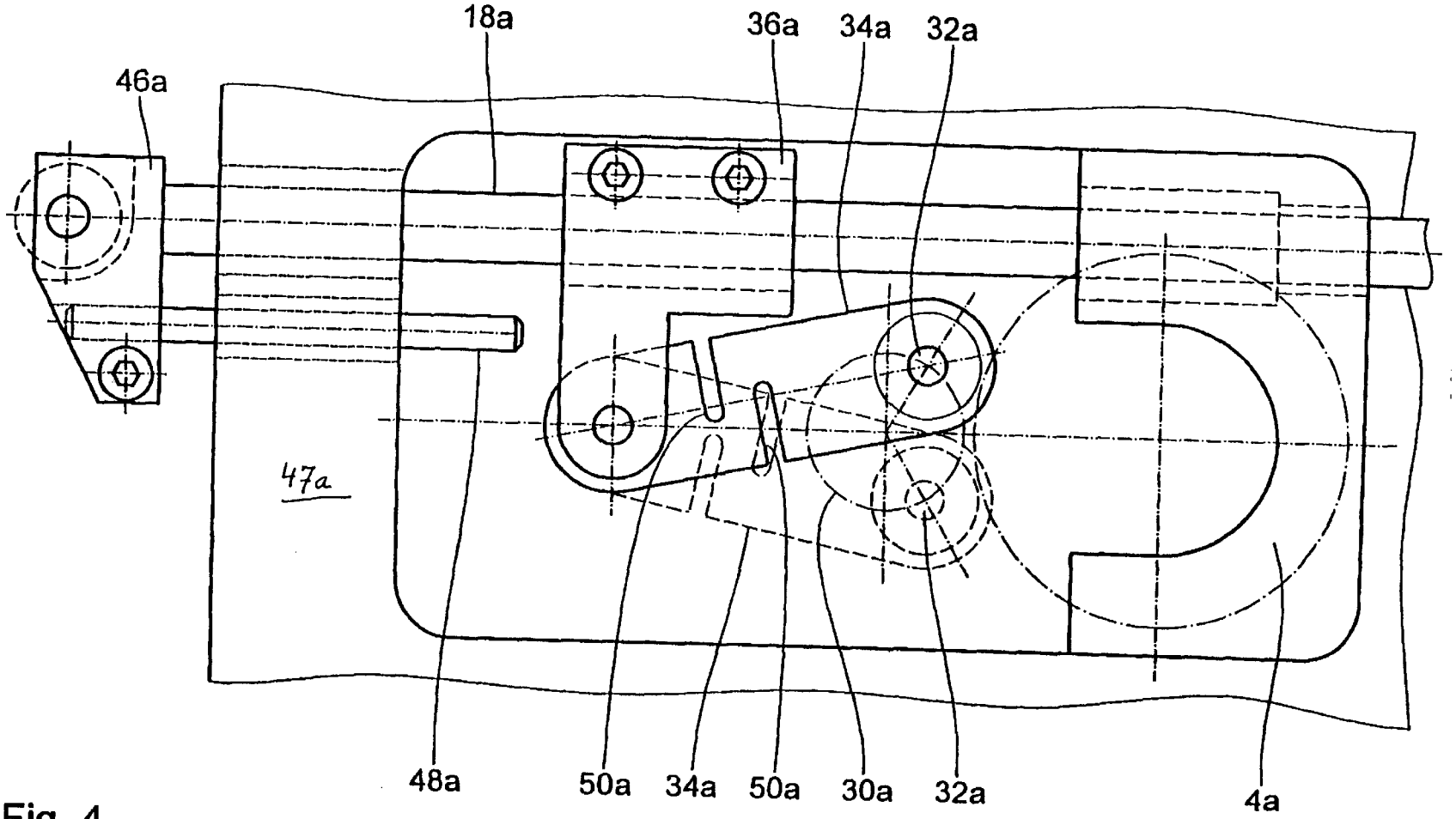
FIG. 4 is an enlarged plan view of certain component parts of a novel drive which is employed in the inverting conveyor of FIGS. 1 to 3.

FIG. 4 shows, drawn to a larger scale, certain details of the structure shown in FIG. 3. The links 34*a* are eccentrically mounted on the disc 30*a* of the crankshaft 22*a* by way of the respective crank pins 32*a* which are angularly offset relative to each other by approximately 120°. FIG. 4 further shows that the pusher 18*a* is secured to a connector 46*a* which is slidable along a rod-shaped guide 48*a* (or which is slidable with such guide relative to a part 47*a*) so that the pusher 18*a* cannot turn about its own axis. The pusher 16*a* of FIG. 3 is held against rotation about its own axis in an analogous fashion.

As can be seen in FIG. 4, each link 34*a* is provided with transversely extending narrow recesses 50*a* which enhance the resiliency or yieldability of such links between the forks 36*a* and the respective crank pins 32*a*.

As already mentioned hereinbefore, the mounting of each of the second sections 4*b*, 4*c*, . . . 4*h* on or in the first section 2*a* of the inverting conveyor 2 is or can be the same as the aforedescribed mounting of the second section 4*a*. FIGS. 1 and 3 merely show certain details of the second section 4*b* and of its operative connection with the first section 2*a* of the conveyor 2. Thus, FIG. 3 merely identifies the parts 38*b*, 40*b* of the drive means serving to turn the section 4*b* about the axis (6*b* in FIG. 1) of the shaft 12*b* in response to rotation of the first section 2*a*. The section 4*b* turns a set of parallel rod-shaped articles 11 clockwise if the section 4*a* is set up to turn rod-shaped articles 11 end-for-end in a counterclockwise direction, or vice versa. This enhances the stability of the inverting conveyor 2 and brings about several additional advantages which will be pointed out hereinafter. The section 4*c* inverts articles in the same direction as the section 4*a*, the next-following second section inverts articles in the same direction as the section 4*b*, and so forth.

The cams 40*a*, 40*b* of FIG. 3 are installed or formed two end walls 41*a*, 41*b* flanking the first section 2*a* the drum-shaped inverting conveyor 2.

Figure 5:
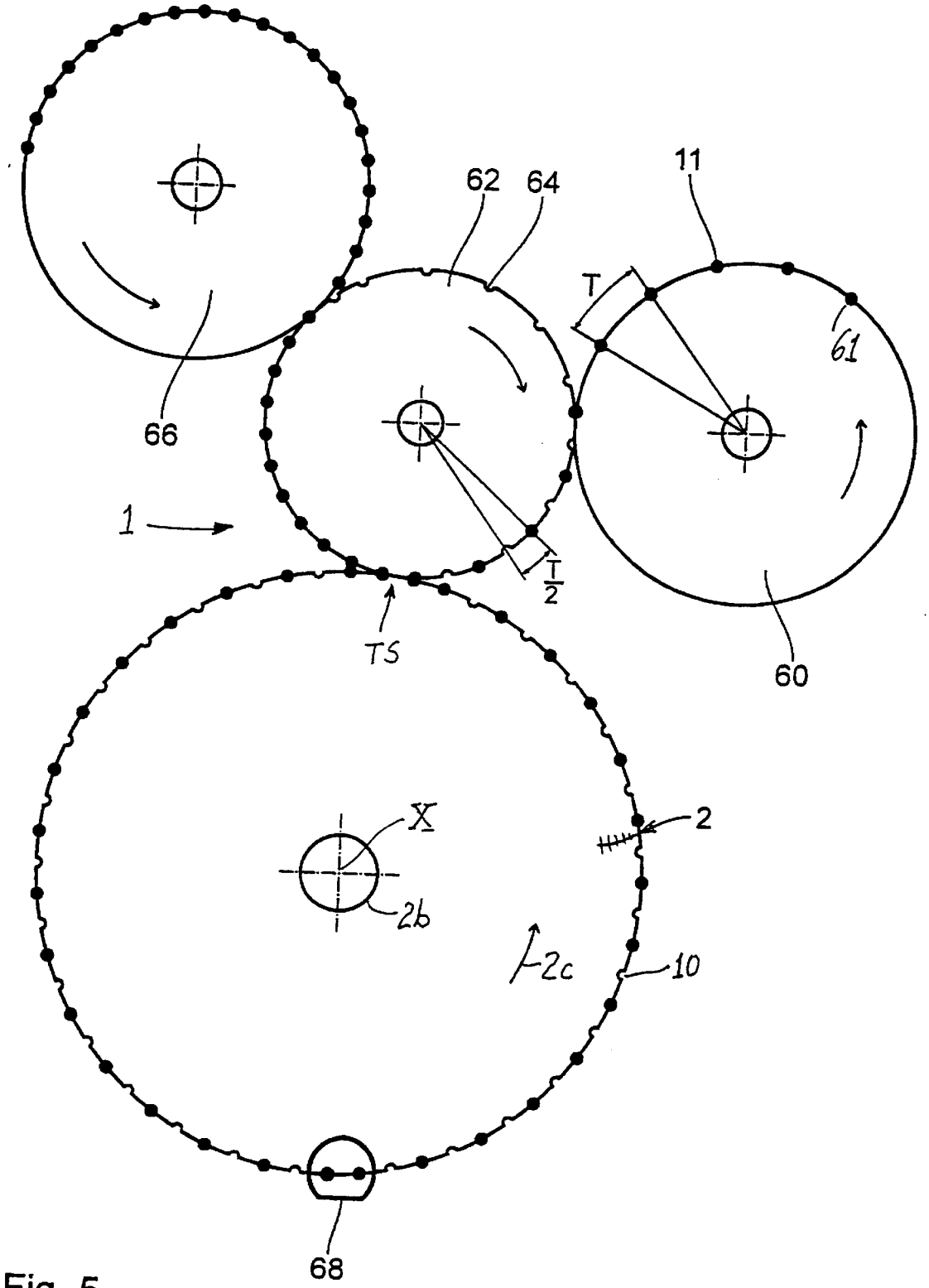
FIG. 5 is a schematic elevational view of a portion of a production line wherein the inverting conveyor of the present invention operates between a filter cigarette making machine and a filter cigarette packing machine.

FIG. 5 illustrates certain parts of a production line which turns out soft or so-called hinged lid packets containing arrays of parallel rod-shaped articles 11 constituting filter cigarettes, filter cigars, filter cigarillos or analogous filter-tipped rod-shaped smokers' products. Such production line can comprise a maker of plain cigarettes, a maker of filter rod sections (mouthpieces) of unit length but normally multiple unit length, a filter cigarette maker which unites plain cigarettes with filter rod sections (e.g., in a manner as described in the '008 patent to Oesterling et al.), a filter cigarette packing machine, and one or more additional machines, e.g., a machine which confines groups of ten cigarette packets each in so-called cartons and a machine which confines arrays of cartons in boxes, crates or the like. The assignee of the present application distributes production lines wherein a maker of plain cigarettes (e.g., a machine known as PROTOS) and a maker of filter rod sections (e.g., a machine known as AF 3/KDF 3) supply plain cigarettes and filter rod sections (normally mouthpieces of double unit length) to a filter cigarette maker (e.g., a machine known as MAX). The filter cigarette maker supplies filter cigarettes to a packing machine (e.g., a machine known as COMPAS 500) which supplies a file of discrete soft or hinged lid packets of, for example, twenty filter cigarettes each to a so-called film wrapper (e.g., a machine known as C 90); the latter supplies cellophane-wrapped filter cigarette packets to a so-called cigarette pack boxer (e.g., a machine known as B 90) which confines groups of packets in cartons, and the pack boxer supplies cartons to a so-called case packer (e.g., a machine known as CP 90) which confines groups of cartons in boxes or crates of cardboard, wood or the like.

Referring again to FIG. 5 there are shown certain parts of a filter cigarette maker which can be of the type disclosed in the aforementioned '008 patent to Oesterling et al. and which, in lieu of the turn-around device of the type disclosed in the '546 patent to Koop, employs the aforedescribed inverting apparatus 1 of the present invention. A first drum-shaped conveyor 60 has axially parallel peripheral flutes 61 for pairs of coaxial filter cigarettes 11 having filter mouthpieces (11*a* in FIG. 2) confronting each other (as shown at 38*a*, 38*b* in FIG. 3 of the '008 patent to Oesterling et al.). Thus, the filter cigarettes 11 on the conveyor 60 form two neighboring rows. The spacing between neighboring flutes 61 of the conveyor 60 shown in FIG. 5 equals T (see also FIG. 2).

The filter cigarettes 11 forming one of the two rows supplied by the conveyor 60 of FIG. 5 should be inverted end-for-end while being advanced by the conveyor 2. To this end, successive filter cigarettes 11 of the one row are transferred into the peripheral flutes 64 of the drum-shaped article supplying conveyor 62. The conveyors 60, 62 and 2 of FIG. 5 are respectively driven to rotate in counterclockwise, clockwise and counterclockwise directions (as indicated by the arrows shown in FIG. 5). The details of the means for driving and for synchronizing the movements of the conveyors shown in FIG. 5 form no part of the present invention.

Successive flutes 61 of the conveyor 60 deliver pairs of filter cigarettes 11 into alternate peripheral flutes 64 of the conveyor 62. The spacing between neighboring flutes 64 equals T/2. Successive filter cigarettes 11 of the row of filter cigarettes in the flutes 64 of the conveyor 62 which are to be inverted during travel with the conveyor 2 are delivered into the flutes 10 of successive second sections 4*a*, 4*b*, 4*c*, . . . 4*h* (not shown in FIG. 5) of the conveyor 2 at the aforementioned transfer station TS.

A group of four successive parallel filter cigarettes 11 reaching the transfer station TS, when the second section 4*a* is in a position to receive filter cigarettes, is transferred into the flutes 10' of the section 4*a* to assume positions corresponding to those shown in FIG. 2. The manner in which successive ones of a series of four equidistant parallel cigarettes 11 are transferred into the flutes 10' of the section 4*a* while the section 4*a* and the corresponding flutes 64 of the conveyor 62 advance past the transfer station TS is well known in the art of transferring rod-shaped articles from one drum-shaped conveyor to another drum-shaped conveyor. As a rule, the pneumatic system of the conveyor 62 ceases to attract the cigarette 11 which has arrived at the station TS, and the pneumatic system of the conveyor 2 is activated to draw air through the respective set of suction ports 20 so that the cigarette which is no longer atracted to the surface bounding the respective flute 64 is attracted to the surface bounding the respective flute 10' in the exposed surface 5*a* of the section 4*a*.

Those filter cigarettes 11 which are delivered by the conveyor 62 to the transfer station TS but are not accepted by the second sections 4*a*, 4*b*, 4*c*, . . . 4*h* (because their filters 11*a* already face in the desired direction) remain in the respective flutes 64 and are delivered into the flutes of a further rotary drum-shaped conveyor 66 which transports (inverted and non-inverted) filter cigarettes to storage, e.g., into the magazine of a packing machine (not shown in FIG. 5).

One of the two parallel rows of parallel filter cigarettes 11 being supplied first by the conveyor 60 and thereupon by the conveyor 62 is caused to move past the transfer station TS toward and onto the conveyor 66. The filter cigarettes 11 of the other of these two parallel rows are transferred from the conveyor 62 onto the conveyor 2 where the filter cigarettes are turned end-for-end (i.e., by 180°) and are simultaneously moved axially (preferably by the length of a filter cigarette for reasons and in a manner as already described with reference to FIG. 2) prior to being returned onto the conveyor 62 for delivery to the conveyor 66. The inverted filter cigarettes 11 enter those (alternate) flutes 64 of the conveyor 62 which are empty during advancement from the conveyor 60 to the transfer station TS. The inverted and non-inverted filter cigarettes 11 advancing from the transfer station TS to the conveyor 66 form a single row wherein the filters 11*a* of all cigarettes face in the same direction. The reasons for the formation of a single row (i.e., for the placing of inverted cigarettes between neighboring non-inverted cigarettes) will be appreciated upon perusal of the preceding description of the structure shown in FIG. 2, particularly the purpose of the spacings T, T/2 and T/4.

The inversion of each filter cigarette 11 which has been transferred into a flute 10' of any one of the eight successive second sections 4*a*, 4*b*, 4*c*, . . . 4*h* at the station TS is completed while such filter cigarette completes a movement through 360° about the axis X of the shaft 2*b*. Furthermore, each filter cigarette 11 orbiting about the axis X is shifted circumferentially of the conveyor 2 through a distance T/2 (i.e., two times T/4) and is thus caused to change its axial position relative to the first section 2*a* by the length of a cigarette due to rotation of the respective second section relative to the first section. Such mode of manipulating the filter cigarettes 11 on their way from the conveyor 60 toward and onto the conveyor 66 is highly desirable and advantageous because none of the cigarettes must be moved (pushed) axially (i.e., lengthwise) by actually sliding along a surface. Thus, the axial positions of the row of non-inverted cigarettes remain unchanged all the way from the conveyor 60 to the conveyor 66, and the axial positions of the cigarettes 11 advancing with the conveyor 2 are changed as a result of turning of sections 4*a*, 4*b*, 4*c*, . . . 4*h* relative to the section 2*a*, i.e., not as a result of any sliding movement of cigarettes relative to the surfaces bounding the respective flutes 10' or 10". The extent (T/2) of circumferential displacement of an inverted filter cigarette 11 during travel with the inverting conveyor 2 is shown schematically in FIG. 5, as at 68. This enables the freshly inverted cigarettes to enter empty flutes 64 during travel at the transfer station TS, i.e., upon completion of the inverting operation.

The configurations of the faces of stationary cams 40*a* for the roller followers 38*a* (which cooperate with the respective cams 40*a* to turn the section 4*a* through angles of 180°) are such that an indexing of the section 4*a* relative to the section 2*a* does not or need not begin immediately upon completed transfer of a cigarette 11 into the foremost oncoming flute 10' or 10" in the exposed surface 5*a* moving past the transfer station TS. For example, the slopes of faces of the cams 40*a* need not change during turning of the foremost filled flute 10' or 10" in the exposed surface 5*a* through an angle of 45°. Actual turning of the section 4*a* through an angle of 180° about the axis 12*a* takes place while the first section 2*a* turns about the axis A from a first angular position at 45° from the position of the foremost flute 10' or 10" at the transfer station TS to the position at 225° from such foremost position.

An advantage of the just described mode of "delayed" indexing of a second secton relative to the first section is that the change in direction of movement of a freshly transferred cigarette from a flute 64 into a flute 10' or 10" need not take place simultaneously with the start of indexing of the flute 10' or 10" relative to the first section 2*a*.

The next-following second section 4*b* is caused to turn relative to the first section 2*a* (under the action of moving means including the stationary cams 40*b* shown in FIG. 3) after the filter cigarette 11 in the foremost flute 10' or 10" of the peripheral surface 5*b* has completed an angular movement through 180° about the axis X of the first section. The inversion of filter cigarettes 11 in the flutes 10' or 10" of the peripheral surface 5*b* is completed while the section 4*b* completes the second half of its orbital movement about the axis X. In addition, inversion of filter cigarettes 11 in the flutes 10' or 10" of the peripheral surface 5*a* takes place while the section 4*a* turns clockwise relative to the first section 2*a*, and inversion of the filter cigarettes 11 in the flutes 10' or 10" of the peripheral surface 5*b* takes place while the section 4*b* turns counterclockwise relative to the first section 2*a* (or vice versa). Otherwise stated, the cams 40*a*, 40*b* compel the respective second sections 4*a*, 4*b* to turn about their respective axes 6*a*, 6*b* during one-half of each revolution of the first section about the axis X, and the turning of the sections 4*a*, 4*b* about the respective axes 6*a*,

6*b* is staggered (i.e., it takes place seriatim or sequentially rather than simultaneously) and takes place in opposite directions.

It will be seen that, while successive filter cigarettes 11 of one row in alternate flutes 64 of the conveyor 62 are moved (e.g., by suction) from the conveyor 62 onto the adjacent second section (e.g., onto the section 4*a*) of the inverting conveyor 2 as soon as they reach the transfer station TS, this station further serves to permit simultaneous transfer of freshly inverted and axially and circumferentially displaced filter cigarettes from the flutes 10' or 10" of the second sections into the adjacent empty flutes 64 of the conveyor 62. The second path for the row of filter cigarettes 11 on the conveyor 62 which are to be transferred onto and inverted on the conveyor 2 is located between (a) the (first) path for the row of filter cigarettes 11 advancing from the conveyor 60 past and beyond the transfer station TS toward and onto the conveyor 66, and (b) the (third) path defined by the conveyor 2. FIG. 5 shows that all paths are or can be circular paths.

Figure 6:
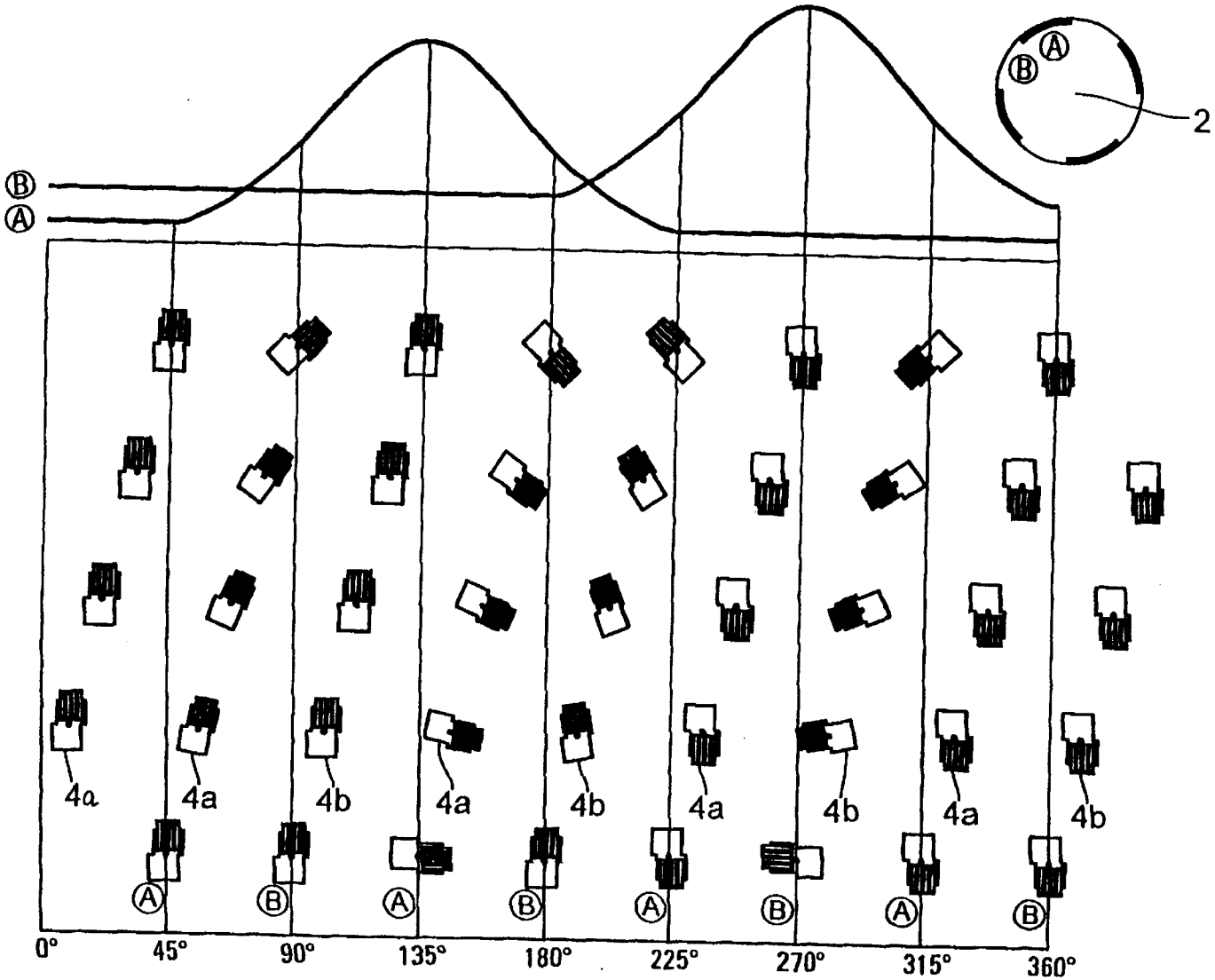
FIG. 6 shows a coordinate system wherein the angular movements of the first section of the improved inverting conveyor are measured along the abscissa and the extent of indexing of the second sections relative to the first section of the improved inverting conveyor is indicated along the ordinate.

The coordinate system of FIG. 6 illustrates one presently preferred mode of manipulating filter cigarettes 11 during travel with the second sections 4*a*, 4*b* of the inverting conveyor 2. The extent of angular displacement of the conveyor 2 about the axis X is measured along the abscissa, and the changes of orientation of second sections 4*a*, 4*b* relative to the first section 2*a* are shown along the ordinate. The curve A at the top of FIG. 6 indicates the composite configuration of the cams 40*a*, and the curve B indicates the composite configuration of the cams 40*b*. The angular positions of the curves A and B relative to the inverting conveyor 2 are shown in the upper right-hand portion of FIG. 6.

As shown in the left-hand portion of FIG. 6, the four flutes (10' or 10") of the surface 5*a* on the second section 4*a* serve to receive filter cigarettes 11 while the first section 2*a* of the inverting conveyor 2 moves the section 4*a* past the transfer station TS. At such time, the angular position of the section 4*a* relative to the first section 2*a* remains unchanged because the faces of the cams 40*a* (curve A) are flat, i.e., the followers 38*a* are not caused to move in the direction of the axis X. All four flutes 10' or 10" of the section 4*a* shown in FIG. 2 are occupied when the section 4*a* completes (with the first section 2*a*) an angular movement through 45° from that (starting) position in which the foremost flute 10' or 10" is ready to receive a filter cigarette 11 at the transfer station TS.

The configurations of the faces of the cams 40*a* begin to change at 45° (see the curve A at the top of FIG. 6) so that the section 4*a* is caused to turn relative to the first section 2*a*, and the simultaneous inversion of the four filter cigarettes 11 in the flutes 10' or 10" of the section 4*a* is completed while the section 2*a* turns from an angular position at 45° to an angular position at 225° from the starting position of the section 4*a*. The section 4*a* is assumed to turn (relative to the first section 2*a*) in a clockwise direction.

The configurations of faces on the cams 40*b* (see the curve B in FIG. 6) are such that the angular position of the section 4*b* relative to the first section 2*a* of the inverting conveyor 2 remains unchanged while the first section 2*a* turns through 180°. The flutes 10' or 10" of the section 4*b* receive four successive parallel filter cigarettes 11 while the first section 2*a* turns from an angular position at 90° to an angular position at 135° from the starting angular position of the section 4*a*. Inversion of filter cigarettes 11 in the flutes 10' or 10" of the section 4*b* begins at 180° and is terminated not later than at 360° (i.e., when the first section 2*a* completes one full revolution about the axis X). The section 4*b* turns (relative to the first section 2*a*, i.e., about the axis 6*b*) in a counterclockwise direction. All this is shown in FIG. 6.

An important advantage of the features that the timings of indexing the sections 4*a*, 4*b*, 4*c*, . . . 4*h* relative to the first section 2*a* are staggered, as well as that the section 4*a* is indexed clockwise whereas the section 4*b* is indexed counterclockwise, that the section 4*c* is indexed clockwise and so forth, is that none of the second sections 4*a*, 4*b*, 4*c*, . . . 4*h* can interfere with angular movements of neighboring second sections (and of the filter cigarettes 11 carried thereby) relative to the first section 2*a*.

FIG. 6 shows that the inversion of filter cigarettes 11 then borne by the section 4*a* is completed at 225°, and the angular position of the section 4*a* relative to the first section 2*a* thereupon remains unchanged during the remaining portion of revolution of the section 2*a* about the axis X (i.e., from 225° to 360°).

The section 4*b* is indexed (counterclockwise) relative to the first section 2*a* while the latter completes the second half of its revolution (from 180° to 360°).

Figure 7:
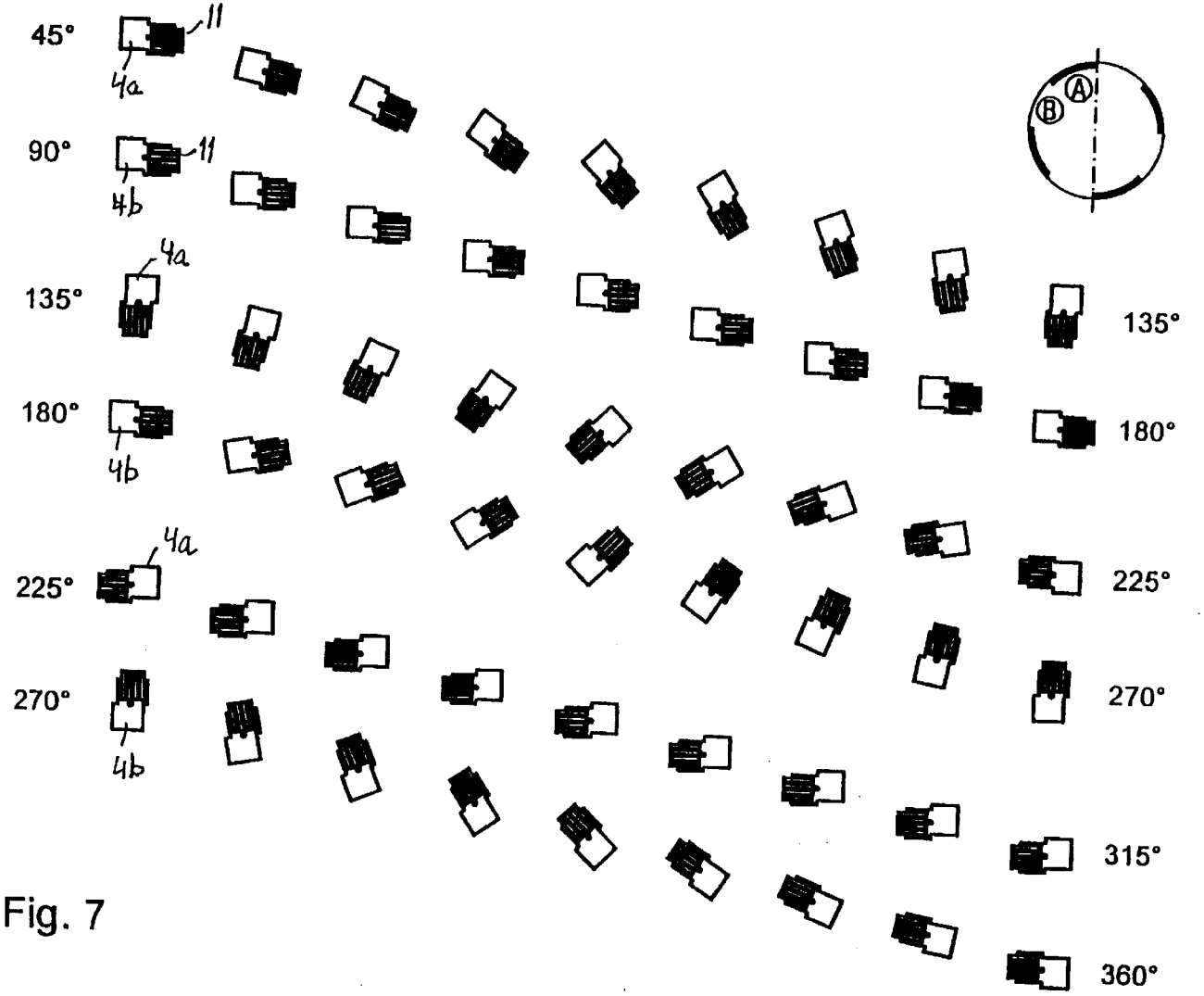
FIG. 7 is a view analogous to that shown in FIG. 6 but presenting a different mode of showing changes in angular positions of second sections in response to rotation of the inverting conveyor.

FIG. 7 illustrates the steps of FIG. 6 in a different way. The topmost row represents clockwise indexing of the second section 4*a* through 90° (from the 45° to the 135° position of the first section 2*a* relative to the axis A); the third line from the top indicates the clockwise indexing of the section 4*a* through another 90° (from the 135° to the 225° position of the first section 2*a*); and the fifth line from the top indicates that the angular position of the already indexed section 4*a* relative to the first section 2*a* remains unchanged while the first section 2*a* performs an angular movement (relative to the axis A) from the 225° to the 315° position.

The second, fourth and sixth lines of the arrangement shown in FIG. 7 indicate that the filter cigarettes 11 carried by the section 4*b* are not indexed while the first section 2*a* turns about the axis A between the 90° and 180° positions but that such filter cigarettes are indexed relative to the first section 2*a* while the latter turns (about the axis A) between the 180° and 270° as well as between 270° and 360° positions. The sections 4*a* and 4*b* are respectively indexed in clockwise and counterclockwise directions. The angular position of the section 4*a* relative to the first section 2*a* remains unchanged while the first section 2*a* turns (about the axis X) from 0° to 45° and from 225° to 360°. The angular position of the section 4*b* relative to the first section 2*a* remains unchanged while the first section 2*a* turns (about the axis X) between 0° and 180°.

An important advantage of the improved method and apparatus is that each of the indexible second sections 4*a*, 4*b*, 4*c*, . . . 4*h* can simultaneously turn, end-for-end, two or more (four in the embodiment shown in FIG. 2) parallel rod-shaped articles 11. This holds true irrespective of the selected number (one, two or more) of second sections. Moreover, by causing the neighboring second sections to turn in opposite directions and to turn during successive intervals (rather than simultaneously), one can reliably avoid clashing of rod-shaped articles 11 on any one of the second sections with the articles on the neighboring second section or sections. The provision of several flutes on each of the second sections renders it possible to turn around several rod-shaped articles 11 per unit of time by resorting to a relatively small number of discrete second sections, i.e., the first section 2*a* need not carry an independently indexible flute 10 for each and every article 11 on the inverting conveyor. This brings about substantial savings in initial and maintenance cost as well as in space requirements of the inverting conveyor. In contrast to the just described features and advantages of the improved apparatus 1 of the present invention, the aforementioned German patents Nos. 1 178 756 and 1 532 099 show apparatus wherein each and every flute and the filter cigarette therein are individually indexed while the filter cigarette orbits about the axis of the drum-shaped inverting conveyor.

Another important advantage of the improved method and apparatus is that it is not necessary to assemble filter cigarettes into batches or piles or groups of contiguous filter cigarettes and to convert the batches of inverted filter cigarettes back into layers of successive parallel cigarettes. This is in-contrast to the teaching of the aforementioned U.K. patent No. 1 538 314.

Since it is now possible to invert several spaced-apart parallel rod-shaped articles in a simultaneous operation, the indexing of the second section(s) relative to the first section 2*a* need not be as abrupt and as short-lasting as in heretofore known apparatus wherein each flute of the inverting conveyor is mounted on the first section of the inverting conveyor by way of a discrete indexible support (reference should be had again to the aforementioned German patents Nos. 1 178 756 and 1 532 099); this renders it possible to avoid the generation of excessive centrifugal forces and to thus simplify the configuration of the means (such as the pneumatic system including the suction ports 20 shown in FIG. 2) for reliably holding the articles 11 in optimum positions during travel with the inverting conveyor. Still further, it is now possible to utilize drum-shaped conveyors (see the conveyors 60, 62, 2 and 66 in FIG. 5) having large diameters; this also permits for a reduction of centrifugal forces acting upon the rod-shaped articles 11 during transport toward, with and away from the inverting conveyor.

It has been found that the mounting of second sections 4*a*, etc. for rotation about axes (6*a*, etc.) which extend radially of the axis X of the first section 2*a* also contributes to important advantages of the improved apparatus 1. Thus, and if the second sections (4*a*, etc.) consist of pairs of substantially mirror symmetrical halves (refer again to FIG. 2), rotation of the second sections relative to the first section 2*a* takes place symmetrically with reference to the periphery of the conveyor 2, i.e., the overall configuration or outline of the conveyor 2 is the same prior as well as subsequent to indexing of any one of the second sections through, for example, 180°.

Another advantage of second sections (such as 4*a*, 4*b*) which are indexible about axes (6*a*, 6*b*) extending radially of the axis (X) of the first section 2*a* is that the second sections can be indexed about their respective radial axes by resorting to relatively simple, compact, reliable and inexpensive drive means which derive motion from the drive means (such as the shaft 2*b* and the associated prime mover) for the first section 2*a*.

The flutes 10" of FIG. 2 are put to use subsequent to indexing of the second section 4*a* through 180°, i.e., it is not necessary to index the section 4*a* back to a starting position when the indexing of four parallel rod-shaped articles 11 with and the evacuation of indexed articles from the flutes 10' of section 4*a* are completed.

An advantage of the spacings T, T/2 and T/4 shown in FIG. 2 is that an indexing of the second section 4*a* about the axis 6*a* results in automatic displacement of rod-shaped articles 11 in the circumferential direction of the inverting conveyor 2 so that the inverted articles 11 can be transferred into the empty (alternate) flutes 64 of the article supplying conveyor 62. The placing of the end faces 11*b* of the filters 11*a* of all rod-shaped articles 11 in the flutes 10' of FIG. 2 into a common plane which includes the axis 6*a* and is normal to the plane P renders it possible to change the axial positions of the articles 11 in the course of the inverting step without it being necessary to cause the articles 11 to slide along the surfaces bounding the respective flutes 10'. The same holds true when the flutes 10" assume the positions of the flutes 10' in FIG. 2 and are utilized to turn a set of four parallel rod-shaped articles 11 through 180° during travel of such articles with the conveyor 2.

An advantage of that portion of the drive means for a second section (such as 4*a*) which is shown in FIG. 4 is that the angular spacing of crank pins 32*a* relative to each other through an angle other than 180° (in FIG. 4, such angle is 120°) renders it possible to avoid any dead center positions in which the forces transmitted by the links 34*a* and acting upon the respective crank pins 32*a* would balance or neutralize each other; this could cause a jamming of the section 4*a* in and relative to the first section 2*a*. Furthermore, such jamming could prevent the gear train 14*a*, 24*a* from ensuring that each revolution of the shaft 2*b* about the axis X results in one-half of a full revolution of the shaft 12*a* about the axis 6*a*.

The dimensions of the drive means for the second sections of the inverting conveyor 2 can be reduced still further if the coil springs (such as the springs 42*a* shown in FIG. 3) are caused to partially surround the respective pushers 16*a*, 18*a*. The rollers 38*a* of FIG. 3 constitute a desirable and advantageous but optional feature of the drive means for the second section 4*a* because they minimize friction and hence the wear upon the faces of the cams 40*a* and the adjacent end portions of the pushers 16*a*, 18*a*.

A further important advantage of the novel drive means for the second sections 4*a*, etc. is that the second sections need not change the direction of their rotation relative to the first section 2*a*, i.e., that each second section is ready to accept a set of for example four parallel rod-shaped articles as soon as such second section has completed an inverting step. This is attributable to the aforediscussed distribution of flutes 10', 10" in the exposed surfaces (such as 5*a*, 5*b*) of the second sections. In other words, the second sections need not perform any idling movements because they are ready to accept a fresh set of parallel cigarettes 11 as soon as they have completed the end-for-end turning of the preceding set of cigarettes. For example, idle strokes of the second sections 4*a*, etc. could not be avoided if the drive means for indexing the second sections were to employ pinions and reciprocable racks mating with such pinions. Each return stroke of the rack would necessitate a reversal in the direction of rotation of a second section.

A further important advantage of the improved inverting apparatus is that it renders it possible to reduce the floor space requirements of a production line wherein a filter cigarette maker (including, for example, the conveyors 60, 62 of FIG. 5) supplies filter cigarettes to a packing machine (including, for example, the conveyor 66 of FIG. 5). The improved apparatus 1 including the inverting conveyor 2 then ensures that the filters 11*a* of all filter cigarettes 11 face in the same direction not later than when they reach the packing machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of inverting filter cigarettes and the like and, therefore, such adaptations should and are intended to be comprehended within the meaning and range of equivalence of the appended claims.

What is claimed is:

1. Apparatus for manipulating elongated rod-shaped articles, comprising:

an inverting conveyor having means for advancing at least one row of successive parallel articles sideways along a predetermined path, the inverting conveyor including at least one turn-around device having means for simultaneously inverting at least two parallel articles of said row end-for-end by turning the at least two parallel articles in a common direction; and means for supplying articles to said advancing means.

2. The apparatus of claim 1, wherein the rod-shaped articles are smokers' products.

3. The apparatus of claim 1, wherein said inverting conveyor comprises a drum and said advancing means includes a plurality of elongated peripheral flutes provided on said drum, said drum including a first section rotatable about a predetermined axis and at least one second section supported by and rotatable with said first section and constituting said at least one turn-around device.

4. The apparatus of claim 3, wherein said at least one second section is rotatable about a second axis extending at least substantially radially of said predetermined axis.

5. The apparatus of claim 4, wherein said flutes include an array of flutes provided on said at least one second section, the flutes of said array including a first group and a second group and said groups being located at opposite sides of a plane including said second axis.

6. The apparatus of claim 5, wherein the flutes of each of said groups include a first flute disposed at a first distance from said second axis and a second flute disposed at a second distance from the respective first flute, said first distance being half said second distance.

7. The apparatus of claim 5, wherein said at least one second section of said drum is rotatable about said second axis from a starting position to a second position to thereby turn the articles in the flutes of said array end-for-end, the flutes of said array being at least substantially parallel to said predetermined axis in at least one of said positions of said at least one second section.

8. The apparatus of claim 4, further comprising means for rotating said first section about said predetermined axis and means for rotating said at least one second section about said second axis through 180° during each revolution of said first section about said predetermined axis.

9. The apparatus of claim 3, wherein said drum comprises a plurality of second sections carried by and rotatable with said first section about said predetermined axis, said second sections being rotatable relative to said first section about discrete second axes extending radially of said predetermined axis.

10. The apparatus of claim 9, further comprising means for rotating said second sections relative to said first section at timely spaced intervals.

11. The apparatus of claim 10, wherein said second sections include at least two successive second sections as seen in a circumferential direction of said drum and said means for rotating includes means for rotating said successive sections one after the other.

12. The apparatus of claim 11, wherein said means for rotating includes means for turning one of said successive second sections upon completed turning of the other of said successive sections through an angle of at least approximately 135°.

13. The apparatus of claim 11, wherein said means for rotating includes means for turning said successive second sections in opposite directions.

14. The apparatus of claim 3, wherein said means for supplying includes a second conveyor having means for delivering articles to be inverted to said flutes and for receiving inverted articles from said flutes.

15. The apparatus of claim 14, wherein said second conveyor includes a drum and said delivering means includes axially parallel peripheral flutes arranged to advance several rows of articles and to deliver successive articles of said at least one row to the flutes of said at least one second section of said inverting conveyor.

16. The apparatus of claim 15, wherein said at least one second section is arranged to return inverted articles to the drum of said second conveyor upon completion of one full revolution of each article about said predetermined axis of said inverting conveyor.

17. The apparatus of claim 16, wherein each flute of said drum of said second conveyor has a length sufficient to receive several coaxial rod-shaped articles.

18. The apparatus of claim 17, wherein said second conveyor is positioned to deliver articles of at least one of said several rows to the peripheral flutes of said inverting conveyor.

19. The apparatus of claim 18, wherein only the articles of said at least one row are delivered to the flutes of said inverting conveyor.

20. The apparatus of claim 16, wherein the flutes of said second conveyor include first flutes arranged to deliver successive articles of said at least one row to the flutes of said inverting conveyor and second flutes alternating with said first flutes and arranged to receive inverted articles from the flutes of said inverting conveyor.

21. The apparatus of claim 3, further comprising a crank drive arranged to rotate said at least one second section about a second axis extending at least substantially radially of said predetermined axis.

22. The apparatus of claim 3, further comprising a first drive arranged to rotate said first section about said predetermined axis and a second drive arranged to rotate said at least one second section about a second axis in response to rotation of said first section, said second axis extending radially of said predetermined axis.

23. The apparatus of claim 22, wherein said first drive includes a shaft defining said predetermined axis and said second drive derives motion from said shaft.

24. The apparatus of claim 23, wherein said second drive includes follower means operatively connected with said at least one second section and arranged to orbit about said predetermined axis in response to rotation of said first section and means for moving a portion of said follower means in parallelism with said predetermined axis in response to rotation of said first section.

25. The apparatus of claim 24, wherein said means for moving a portion of said follower means comprises a stationary cam having a face tracked by said portion of said follower means.

26. The apparatus of claim 24, wherein said portion of said follower means includes a reciprocable follower member tracking at least one cam of said moving means, a crankshaft coupled with said at least one second section, and a link connecting said follower member with said crankshaft.

27. The apparatus of claim 26, wherein said at least one second section includes a shaft defining said second axis and said follower means further comprises a gear train arranged to transmit torque between said crankshaft and said shaft of said at least one second section.

28. The apparatus of claim 27, wherein said gear train has a ratio of two-to-one.

29. The apparatus of claim 24, wherein said second drive is arranged to turn said at least one second section about said second axis through 180° in response to each full revolution of said first section about said predetermined axis.

30. The apparatus of claim 24, further comprising means for biasing said portion of said follower means against said moving means.

31. The apparatus of claim 24, wherein said at least one second section includes a shaft defining said second axis and said follower means comprises a plurality of pushers operatively connected with the shaft of said at least one second section.

32. The apparatus of claim 31, wherein said pushers are arranged to act upon angularly spaced-apart portions of a crankshaft forming part of said second drive and drivingly connected to the shaft of said at least one second section.

33. The apparatus of claim 32, wherein said portions of said crankshaft are angularly spaced apart by at least approximately 120°.

34. The apparatus of claim 1, wherein said inverting conveyor forms part of a cigarette making machine.

* * * * *